United States Patent [19]

Govertsen

[11] Patent Number: 4,738,887

[45] Date of Patent: Apr. 19, 1988

[54] WAX APPLICATOR BUFFER

[76] Inventor: Lloyd G. Govertsen, R.D. 4, Box 201, Hudson, N.Y. 12534

[21] Appl. No.: 817,394

[22] Filed: Jan. 9, 1986

[51] Int. Cl.[4] ..... B08B 1/00

[52] U.S. Cl. ..... 428/133; 428/455; 15/104.93

[58] Field of Search ..... 15/104.93, 236 R, 105; 428/455, 133

[56] References Cited

U.S. PATENT DOCUMENTS

| | | | |
|---|---|---|---|
| 320,530 | 6/1885 | Barstow | 15/236 R |
| 792,676 | 6/1905 | Staples | 15/236 R |
| 932,388 | 8/1909 | Hartsock | 15/104.93 |
| 1,189,499 | 7/1916 | Severns | 15/104.93 |
| 1,370,712 | 3/1921 | Steinbrenner | 15/104.93 |
| 2,245,469 | 6/1941 | Ecklund et al. | 15/236 R |
| 2,828,219 | 3/1958 | Heiges et al. | 428/455 |
| 3,094,735 | 6/1963 | Hanlon | 15/104.93 |
| 3,816,863 | 6/1974 | Thielemann, Jr. | 15/236 R |
| 4,054,962 | 10/1977 | Janke | 15/105 |

FOREIGN PATENT DOCUMENTS

| | | | |
|---|---|---|---|
| 463503 | 3/1950 | Canada | 15/236 R |
| 1188385 | 9/1962 | France | 15/104.93 |
| 67842 | 5/1944 | Norway | 15/104 R |
| 1257302 | 12/1971 | United Kingdom | 15/104.93 |

*Primary Examiner*—Nancy A. Swisher

*Attorney, Agent, or Firm*—Schmeiser, Morelle & Watts

[57] ABSTRACT

A refillable applicator-buffer for applying and buffing wax on skis, toboggans and running surfaces of similar winter sports equipment.

5 Claims, 1 Drawing Sheet

WAX APPLICATOR BUFFER

FIELD OF THE INVENTION

This invention relates generally to snow skiing accessories and the method of making same, and more particularly to a Wax Applicator-Buffer for applying wax composition to the runners of skis, toboggans and the like.

BACKGROUND AND OBJECTS OF THE INVENTION

That ski runners, toboggans and snow or ice sliding apparata encounter varying degrees of slide or glider friction is well known to skiiers, ice racers, tobogganers and others whoc practice snow or ice gliding winter sports. Inability to lessen the frictional drag factor of any running surface could ultimately lead to accidents on the gliding medium. For example, the easier a ski glides, the safer it is to use and execute skiing control. This is because the easier a ski moves, the less effort is required by the skiier; and thus, the concomitant reduction of required physical effort will reduce body muscular fatigue.

To reduce the aforementioned friction, it has been common practice for winter sports enthusiasts to wax and buff the runners or contact surfaces of their ice and snow gliding equipment. This generally requires accessory apparata (separate for applying wax and buffing it then, to insure minimum drag coefficient). Further, many enthusiasts, particularly skiiers, have developed personal likes for special wax compositions; some even compound their own wax mixtures.

In addition to developing specific personal likes for custom-made wax compounds, the more expert enthusiasts develop their own technique in applying the wax. A novice must learn, by trial and error, to develop such a technique on his or her own.

Another seeming disadvantage to the present waxing-/buffing activity is that paraphernalia for both application and buffing, as well as various compositions, must be carried by the enthusiast throughout the sporting activity.

It is therefore an object of this invention to provide a means for applying wax to the runners or gliders of the aforementioned equipment.

Another object of the invention is to provide a means for buffing the wax, preferably in a singular application-buffing action.

It is yet another object of the invention to provide the aforementioned facilities in a reusable or reconstructable form.

A concomitant object of this invention is to provide a method whereby one may construct and practice the invention.

Objects and advantages of the invention are set forth herein and shall be ovbious herefrom, or they may be learned by diligent practice with the invention. The invention consists in the combinations and improvements herein shown and described.

SUMMARY OF THE INVENTION

It has been found that the objects of this invention may be realized by forming, preferably cutting, from a block of ordinary cork a body conformable to the human hand. The block may be reversible, i.e. having top and bottom applicating-buffing surfaces.

A plurality of holes, or foramens (foramina), is bored in an applicating surface or, if top and bottom surfaces are to be used for application and buffering, completely therethrough; and the foramina are filled with a normally solid but readily meltable wax composition. The device is properly dressed and trimmed with an ordinary clothes iron, at approximately 275° F., on all the applicator surfaces. The wax permeates the cork body, after continued usage, and eventually will give the user an applicator-buffer which will last for a significant amount of time.

As wax is depleted from the cork pad, it may be replenished by using the hot dressing iron to melt new composition and direct its flow into the foramina. Redressing is performed again, as above described.

After wax is applied to the equipment runners or ice/snow contact surfaces, continued rubbing by the user with the applicator-buffer will result in a buffing of the wax being then applied. This buffing takes place through frictional contact (rubbing) by the cork body. The combination of a wax applicator-buffer decreases by 50%, the accessory equipment normally required to be carried by the skiier or sleder. Such facility allows the carriage of additional applicator-buffers, which are quite light, in order to meet the demands of changing snow conditions during the day's sporting activity.

It should be understood that the foregoing general description and the following detailed description as well are exemplary and explanatory of the invention. Thus, while the inventor has discussed the filling of the foramina with ski or runner wax, it should be apparent to one of ordinary skill in the art that they may be filled with any meltable, spreadable conditioning compound which is to be applied to an essentially cool surface and thereafter buffed to some preferred finish. It could have applications in dressing leather, vinyl upholstering (such as on automobile dashboards), or the like. Therefore, the invention in its broader aspects is not limited to the specific embodiments herein shown and described as the prefered embodiment, but may be made therefrom within the scope of the accompanying claims, without departing from the principles of the invention nor sacrificing its advantages.

DESCRIPTION OF THE PREFERRED EMBODIMENT

Figure 1:
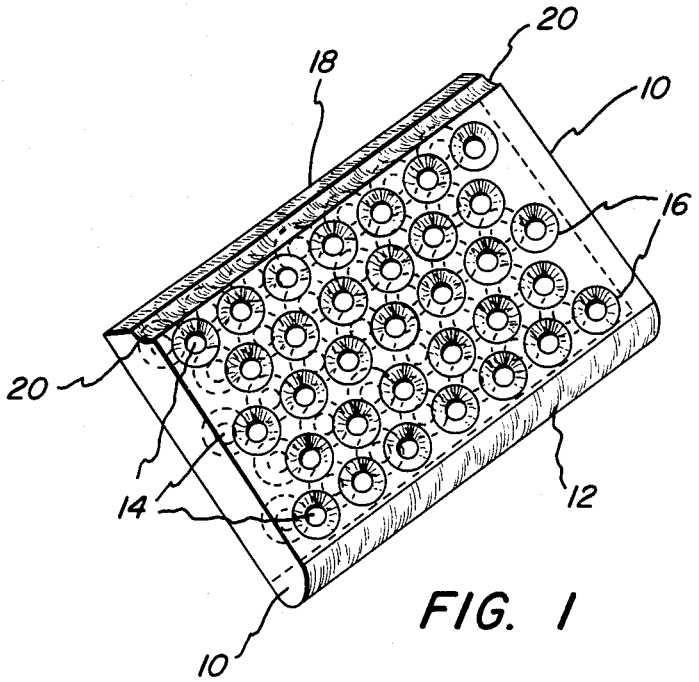
FIG. 1 is an isometric drawing of the invention.

Referring now more particularly to FIG. 1 of the accompanying drawings, there is illustrated the preferred arrangement of the applicator buffer for use especially by skiiers. The body 10 which is to be made of a light, elastic and somewhat porous material is herein composed of cork. The body is shaped so as to make it conformable to the human hand and thereby ease its usage should the user elect to wear gloves during the application and buffing processes. Surface 12 is rounded to rest in the subpalm while second surface 10 may be gripped by the finger tips.

A plurality of holes (foramina) 14, in the preferred embodiment, are bored completely through the body 10. Either subsequent to the boring, or concurrently therewith, each foramen is countersunk 16. The countersinking allows for a greater amount of the waxing composition to be then disposed within the various foramina. This also gives the effect of forming spool-like slugs of wax within the various foramina; a significant distinction between the instant invention and prior art, which contains its various cleaning or waxing compounds interstitially bound to the applicator tool.

Figure 2:
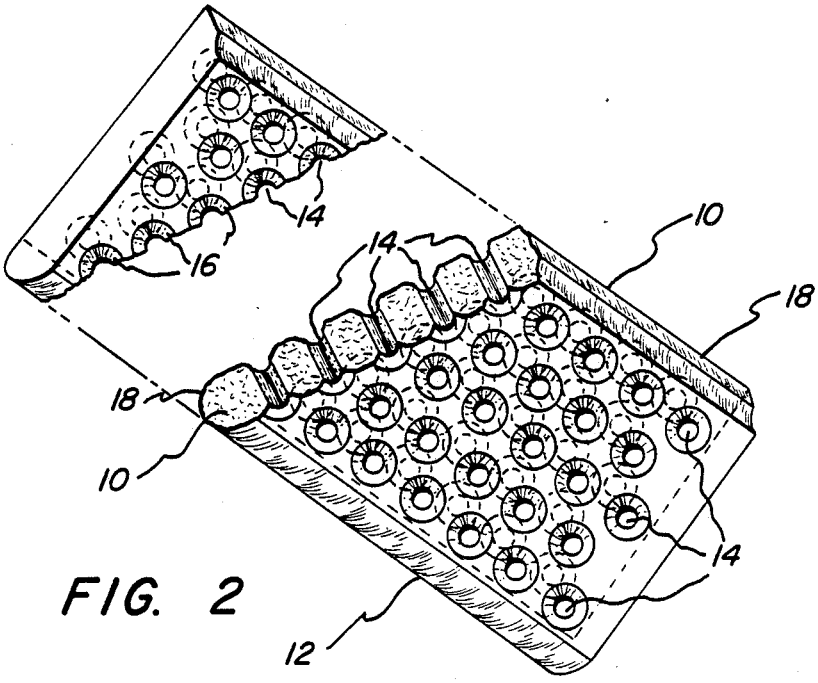
FIG. 2 is an exploded isometric, nominally top view of the invention.

FIG. 2 clearly depicts foramina 14 passing completely through applicator body 10. Countersinks 16 are clearly depicted in this illustration. As one may readily observe, the cork body, being porous but not spongenous, will adhesively retain any dense or highly viscous liquid medium pored into the foramina. However, until the wax composition begins to permeate the somewhat porous cork, the spool geometry given to it by the countersinks 16 appearing at the ends of each foramen 14, will insure retention of the solidified composition within the body.

The particular geometry of the applicator-buffer, namely surfaces 12 and 18 serves to ease handling. In the preferred embodiment, surface 12 has a ¼" radius while second surface 18 is comprised essentially of a ¼" flat rubbing surface. By trimming concave surface 20 into the body, the inventor has provided an applicator-buffer surface for waxing and buffing the narrow flat grooves on ski bottoms. As will be readily apparent to those of ordinary skill in the art, different geometrical shapes may be employed for special applications as well as for retaining the wax compound within the block.

The invention in all of its aspects and variations may be practiced within the limits established by the following claims.

I claim:

1. A refillable applicator-buffer for applying and buffing spreadable coatings to skis surfaces comprising:

a buffing body adapted for holding spreadable coating material;

a plurality of essentially cyclindrical holes bored into said body and penetrating at least one applicating surface therein; and coating material to occupy the foramina of said body, whereby said material is retained, after it is placed in said foramina, by the contact of said material with the interior surfaces of said foramina.

2. The invention of claim 1 wherein said body further comprises a cork buffing block.

3. The invention of claim 1 wherein said foramina are countersunk relative to said applicating surface.

4. A method of preparing a reusable spreadable coating application-buffer for applying wax to ski surfaces comprising the steps of:

creating foramina of essentially cylindrical bore holes to accept additional composition during a filling step, in a block of light, elastic, cork-like material; and filling said foramina with melted, normally solid, spreadable coating composition.

5. The method of claim 4 wherein creating further comprises preparing essentially cylindrical bore holes that are countersunk so as to accept additional composition during said filling step.

* * * * *